US011777197B2

(12) United States Patent
Schrape et al.

(10) Patent No.: US 11,777,197 B2
(45) Date of Patent: Oct. 3, 2023

(54) REMOTE KEY WITH AN EXTERNAL LOOP ANTENNA

(71) Applicant: Hella GmbH & Co. KGaA, Lippstadt (DE)

(72) Inventors: Jörg Schrape, Lippstadt (DE); Christopher Kampa, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 32 days.

(21) Appl. No.: 16/978,008

(22) PCT Filed: Apr. 11, 2019

(86) PCT No.: PCT/EP2019/059192
§ 371 (c)(1),
(2) Date: Sep. 3, 2020

(87) PCT Pub. No.: WO2019/206650
PCT Pub. Date: Oct. 31, 2019

(65) Prior Publication Data

US 2021/0376456 A1 Dec. 2, 2021

(30) Foreign Application Priority Data

Apr. 23, 2018 (DE) ..... 10 2018 109 671.2

(51) Int. Cl.
*H01Q 1/32* (2006.01)
*H01Q 7/00* (2006.01)

(52) U.S. Cl.
CPC ..... *H01Q 1/3241* (2013.01); *H01Q 7/00* (2013.01)

(58) Field of Classification Search
CPC ..... H01Q 1/3241; H01Q 7/00; H01Q 1/38
See application file for complete search history.

(56) References Cited

U.S. PATENT DOCUMENTS

| | | | | |
|---|---|---|---|---|
| 4,725,827 | A | 2/1988 | Gallegos et al. | |
| 2008/0036674 | A1* | 2/2008 | Riedel | H01Q 19/108 343/818 |
| 2012/0206302 | A1* | 8/2012 | Ramachandran | H01Q 1/22 343/866 |
| 2014/0285385 | A1 | 9/2014 | Aoki et al. | |
| 2015/0109103 | A1* | 4/2015 | Shimura | H01Q 1/3241 340/5.61 |
| 2017/0352943 | A1* | 12/2017 | Sung | H01Q 1/3241 |
| 2018/0151949 | A1* | 5/2018 | Lin | H01Q 1/3241 |

FOREIGN PATENT DOCUMENTS

| | | | |
|---|---|---|---|
| DE | 20100389 | U1 | 5/2001 |
| DE | 10012438 | A1 | 9/2001 |
| DE | 102006011724 | A1 | 9/2007 |

(Continued)

*Primary Examiner* — Hai V Tran
*Assistant Examiner* — Michael M Bouizza
(74) *Attorney, Agent, or Firm* — Husch Blackwell LLP

(57) ABSTRACT

A remote key is provided with an electronic wiring arrangement for generating and processing signals. The remote key includes a first antenna for transmitting and/or receiving the signals, and a wiring carrier on which the antenna is formed as a track. The remote key also includes a housing in which the wiring carrier, the first antenna and the electronic wiring arrangement are arranged. The housing comprises a second antenna.

10 Claims, 3 Drawing Sheets

(56) References Cited

FOREIGN PATENT DOCUMENTS

| | | | |
|---|---|---|---|
| DE | 112013001881 | T5 | 2/2015 |
| DE | 102016116904 | A1 | 3/2017 |
| EP | 3330108 | A1 | 6/2018 |
| FR | 2748161 | A1 | 10/1997 |
| WO | 02071536 | A1 | 9/2002 |

* cited by examiner

REMOTE KEY WITH AN EXTERNAL LOOP ANTENNA

CROSS REFERENCE

This application claims priority to PCT Application No. PCT/EP2019/059192, filed Apr. 11, 2019, which itself claims priority to German Application No. 10 2018 109671.2, filed Apr. 23, 2018, the entirety of both of which are hereby incorporated by reference.

FIELD OF THE INVENTION

The invention relates to a remote key with an electronic wiring arrangement for generating and processing signals with a first antenna for transmitting and/or receiving the signals, with a circuit carrier on which the antenna is formed as a track and with a housing in which the circuit carrier, the first antenna and the electronic wiring arrangement are arranged.

BACKGROUND

A remote key is known from document DE 102 09 133 A1 in which a key bit or a part of the housing made of metal is used as a transmission antenna. Use of the key bit or part of the housing made of metal as a transmission antenna did not catch on in practice. Instead, remote keys tend to be used that employ external loop antennas that are arranged as a track on the circuit carrier of the remote key. The wiring arrangement, in which the functions of the remote key are implemented, is also to be located on the circuit carrier. The wiring arrangements are extended due to the fact that remote keys continually have to fulfil new functions. As the remote key may not increase in size, there is an increasing shortage of installation space in the remote key housings. Consequently, the installation space intended for implementing the antenna is to be reduced in order to make space for enlarging the wiring arrangement. This modification should not be detrimental to the range of the antenna or the remote key, however.

SUMMARY OF THE INVENTION

The invention is based on the task of improving the range of the remote key despite reducing the amount of installation space for the antenna.

According to the invention, this task is solved by the housing containing a second antenna, i.e. the second antenna is part of the housing.

In contrast to what is known from document DE 102 09 133 A1, the first antenna to be located on the circuit carrier is not replaced by the new second antenna. On the contrary, the first antenna is left on the circuit carrier. It is possible to reduce the size of the first antenna in comparison to the antennas in known remote keys. The range of the remote key in accordance with the invention is not achieved by the first antenna alone but in conjunction with the second antenna. Because it is formed by part of the housing or forms part of the housing, this antenna is larger than the first antenna encased by the housing. This makes it possible for the second antenna to have a higher radiation resistance and/or a higher degree of efficiency.

According to the invention, it is possible for the first antenna and the second antenna to be inductively coupled. This makes it possible to exchange signals between the first and the second antenna. As the first antenna is electrically connected to the wiring arrangement, it is also possible to exchange via the first antenna signals between the second antenna and the wiring arrangement and vice versa without the second antenna and the wiring arrangement having to be galvanically connected to each other. This makes a conductive connection between the housing and the wiring arrangement superfluous for an exchange of signals between the second antenna and the wiring arrangement. The second antenna is also used for an exchange of signals with the environment, especially with a vehicle in the vicinity of the remote key. In contrast, the first antenna no longer communicates directly with the environment. The first antenna is an intermediate station in the exchange of signals between the wiring arrangement and the second antenna that also supplies the second antenna with the transmission power for transmitting signals to the environment and receivers in the vicinity.

Preferentially, the first antenna and/or the second antenna are external loop antennas.

The second antenna can be a metal coating on a plastic part of the housing or at least one coating on at least one plastic part. Similarly, it is possible for the second antenna to be a metal part or at least feature a metal part. The metal part may be a housing part. The metal part(s) of the second antenna may be embedded or inserted in one or more plastic parts of the housing.

The external loop antennas beneficially feature a slot or a gap. The width of the slot or gap is beneficially selected in such a way that a resonance is formed at a desired frequency.

The housing of a remote key in accordance with the invention may feature an upper side, a lower side and sides or side walls. The second antenna may essentially be located in the sides or side walls. The sides or side wall may form a mantle or a frame that extends between the upper side and the lower side.

In accordance with the invention, the remote key may feature buttons for operation. It is possible for the remote key to provide by radio the user's authorization to unlock and start the vehicle without the user having to actuate the key.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

A remote key F in accordance with the invention features a circuit carrier 1 on which a wiring arrangement is arranged (not shown). The wiring carrier 1 also provides for a first Antenna 2 in addition to the wiring arrangement. The first antenna 2 is formed by a track printed onto circuit carrier 1. Antenna 2 is an external loop antenna.

The circuit carrier 1 is surrounded by a housing 3. A second antenna 4 is provided for in the housing 3. The latter is inductively coupled to the first antenna 2 in such a way that the first antenna 2 can transfer energy and signals to the second antenna 4 so that the second antenna 4 can transmit the signals into the environment of the radio key and so that the second antenna 4 can transmit signals to the first antenna 2 received from the environment by the second antenna 4.

Figure 1:
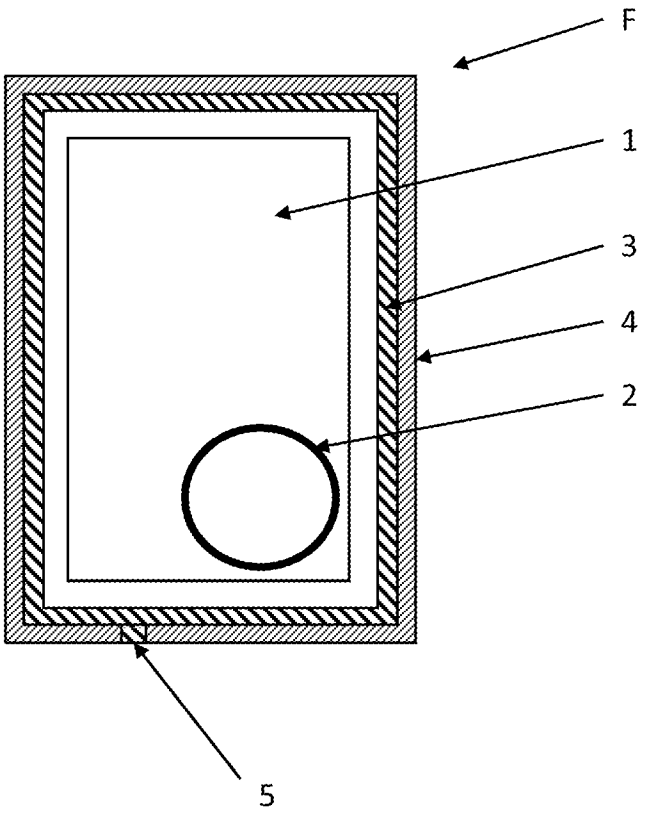
FIG. 1 is a schematic diagram of a remote key in accordance with the invention.
Figure 2:
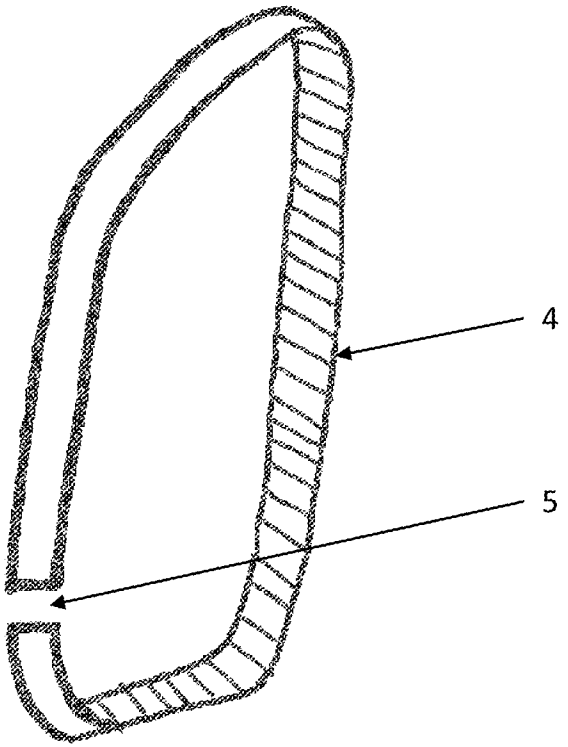
FIG. 2 is a second antenna of a remote key in accordance with the invention.
Figure 3:
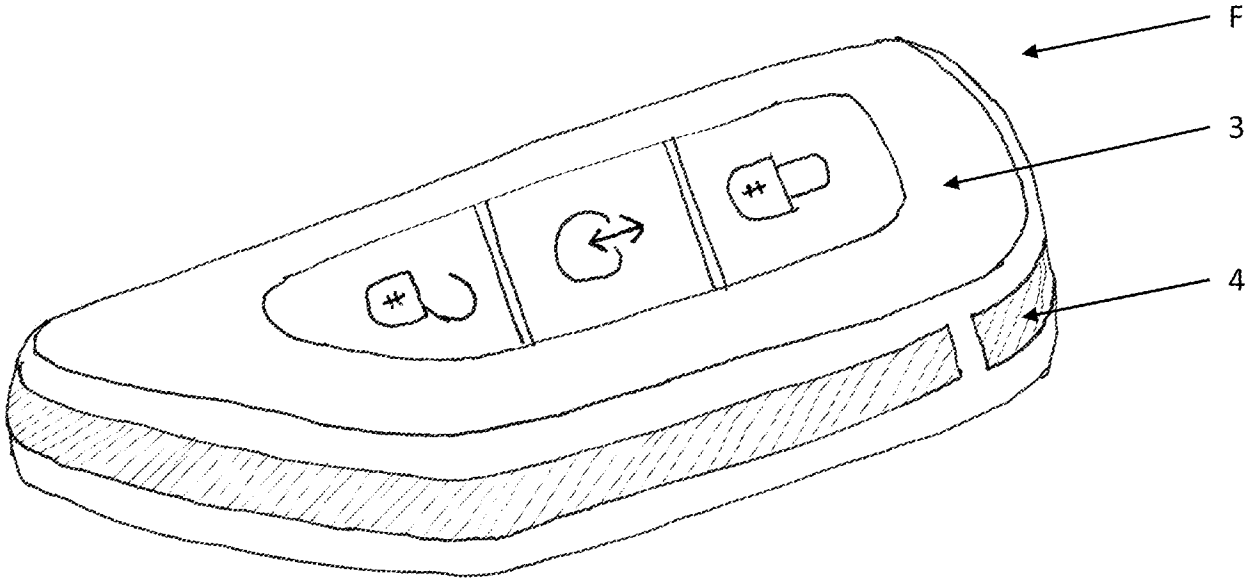
FIG. 3 is a remote key in accordance with the invention with the second antenna from FIG. 2 without battery compartment cover.

As shown in FIG. 2, the second antenna can be a band-like structure made of two zinc diecast metal parts connected to each other. These can be inserted between an upper part and a lower part of the housing and form a circumferential mantle area of the housing of a remote key in accordance with the invention that is shown in FIG. 3.

LIST OF REFERENCE SYMBOLS

F Remote keys
1 Circuit carrier
2 First antenna
3 Housing
4 Second antenna
5 Slot for adjusting resonance of the housing element

The invention claimed is:

1. A remote key comprising:

an electronic wiring arrangement for generating and processing signals;

a first antenna for transmitting and/or receiving the signals;

a wiring carrier on which the first antenna is formed as a track;

a housing having an upper side and a lower side fitted together to form a recessed channel at a boundary between the upper side and the lower side and to form an interior region in which the wiring carrier, the first antenna, and the electronic wiring arrangement are arranged;

a second antenna including:

a first metal part formed from a first diecast;

a second metal part formed from a second diecast;

wherein the first metal part and the second metal part are assembled together to form a band-like structure; and wherein the first metal part and the second metal part are positioned and located within the recessed channel.

2. The remote key in accordance with claim 1, wherein the first antenna and the second antenna are inductively coupled.

3. The remote key in accordance with claim 1, wherein at least one of the first antenna and the second antenna are external loop antennas.

4. The remote key in accordance with claim 3, wherein the second antenna features a metal coating on a plastic part of the housing or at least one coating on at least one plastic part.

5. The remote key in accordance with claim 3, wherein the second antenna is a metal part or features at least one metal part.

6. The remote key in accordance with claim 5, wherein the metal part is a housing part.

7. The remote key in accordance with claim 5, wherein the metal part(s) of the second antenna are embedded or inserted in one or more plastic parts of the housing.

8. The remote key in accordance with claim 3, wherein the external loop antenna features a slot.

9. The remote key in accordance with claim 1, wherein the remote key features buttons for operation.

10. The remote key in accordance with claim 1, wherein the recessed channel includes a depth, and wherein a thickness of the second antenna is less than or the equal to the depth of the recessed channel.

* * * * *